US008342354B2

(12) United States Patent
Letica

(10) Patent No.: US 8,342,354 B2
(45) Date of Patent: Jan. 1, 2013

(54) MOLDED PLASTIC CONTAINER COMBINATION INCLUDING A SNAP-ON SNAP RING

(75) Inventor: Anton Letica, Bloomfield Hills, MI (US)

(73) Assignee: Letica Corporation, Rochester, MI (US)

( * ) Notice: Subject to any disclaimer, the term of this patent is extended or adjusted under 35 U.S.C. 154(b) by 1731 days.

(21) Appl. No.: 11/133,501

(22) Filed: May 20, 2005

(65) Prior Publication Data

US 2006/0261067 A1 Nov. 23, 2006

(51) Int. Cl.

| | |
|---|---|
| ***B65D 51/18*** | (2006.01) |
| ***B65D 25/00*** | (2006.01) |
| ***B65D 41/18*** | (2006.01) |
| ***B65D 6/34*** | (2006.01) |
| *B65D 21/00* | (2006.01) |

(52) U.S. Cl. ..... 220/254.7; 220/256.1; 220/701; 220/642; 206/508

(58) Field of Classification Search ..... 220/256.1, 220/254.7, 254.1, 780, 783, 789–791, 797, 220/798, 696, 699–701, 656, 657, 659, 642, 220/638, 648, 640; 206/503, 508
See application file for complete search history.

(56) References Cited

U.S. PATENT DOCUMENTS

| | | | | |
|---|---|---|---|---|
| 3,139,213 | A | 6/1964 | Edwards | |
| 4,308,970 | A * | 1/1982 | Von Holdt | 220/790 |
| 4,356,930 | A | 11/1982 | Roper | |
| 4,380,305 | A * | 4/1983 | Von Holdt | 220/782 |
| 4,397,404 | A | 8/1983 | Blanchette | |
| 4,530,442 | A | 7/1985 | Vogel, Jr. et al. | |
| 4,574,974 | A * | 3/1986 | von Holdt | 220/782 |
| 4,667,843 | A * | 5/1987 | Galer | 220/798 |
| 5,307,949 | A | 5/1994 | Von Holdt, Jr. | |
| 5,842,593 | A | 12/1998 | Von Holdt | |
| 5,913,446 | A * | 6/1999 | von Holdt et al. | 220/659 |
| 6,213,301 | B1 | 4/2001 | Landis et al. | |
| 6,325,213 | B1 | 12/2001 | Landis, II | |
| 6,547,093 | B1 | 4/2003 | Messer et al. | |
| 6,588,618 | B1 | 7/2003 | Davis | |
| 6,964,348 | B2 * | 11/2005 | Breimon et al. | 220/783 |
| 2003/0221987 | A1 | 12/2003 | Trude | |

FOREIGN PATENT DOCUMENTS

DE 3504192 A1 * 8/1986

* cited by examiner

*Primary Examiner* — Robin Hylton
(74) *Attorney, Agent, or Firm* — Young Basile Hanlon & MacFarlane PC

(57) ABSTRACT

A cylindrical molded plastic container is adapted to receive a snap-on snap-ring which acts as a transition structure between the container sidewall and a suitably configured closure. The snap-ring does not require sonic or friction welding and thus reduces manufacturing costs in the production of the container. The container may be used to ship and store paint or other ingredients.

3 Claims, 2 Drawing Sheets

MOLDED PLASTIC CONTAINER COMBINATION INCLUDING A SNAP-ON SNAP RING

FIELD OF THE INVENTION

This invention relates to molded plastic containers of the type using a "snap-ring" as a transition structure between the container and a closure or lid.

BACKGROUND OF THE INVENTION

The use of a snap-ring to provide a transition structure between the top of a cylindrical container and a sealing closure for said container is described in U.S. Pat. No. 6,588,618 issued Jul. 8, 2003 to Christopher Davis and assigned to Letica Corporation of Rochester, Mich. The Davis patent discloses a snap-ring adapted to be permanently secured to the top peripheral edge of a molded plastic container by welding or adhesive bonding. After the snap-ring is essentially permanently secured to the container, a closure of suitable design may be removably attached to the snap-ring to seal the container and the contents thereof. This design provides an effective substitute for metal paint cans with conventional lids.

Transition rings which do not require welding or bonding but can be snapped onto a container are known. An example is shown in U.S. Pat. No. 4,356,930, issued to Roper on Nov. 2, 1982. The Roper ring, called an "engagement ring," snaps into the upper edge of a container sidewall having an undercut and provides an inboard upward annular projection to receive a lid.

The Roper engagement ring depends entirely on the fit between the top edge of the container and an inverted u-shaped slot in the engagement ring to transfer vertical stacking loads from the lid or ring to the container sidewall. This creates the potential for distortion of the ring under load and a loss of seal quality around the top of the container.

SUMMARY OF THE INVENTION

The primary objective of the present invention is to provide a plastic container including a snap-ring capable of being joined to a molded plastic container by way of a simple snap-on manipulation and which is thereafter capable of sealingly receiving a closure for the container. Such a snap-ring and container combination eliminates the need for welding or adhesive bonding to secure the snap-ring to the container. Moreover, the subject invention involves a feature on the container to provide an effective vertical load transfer whereby vertical loads caused by stacking filled and sealed containers on top of one another are transferred to the container sidewall by positive contact in one or more areas other than the primary seal at the top edge of the container.

The snap-on snap-ring of the present invention is made from injection molded plastic and exhibits an annular structure defining outer and inner portions. The outer portion defines an inverted u-shaped channel, the outer wall of which cooperates with an undercut on the top of the container sidewall to snap lock the snap-ring to the container. The snap ring further comprises an inner stacking surface which sits atop a shoulder formed on the inner surface of the container sidewall. The inner portions of the snap-ring comprise an upstanding annular projection corresponding substantially to the locking annular 30 disclosed in the aforementioned Davis patent to receive the inverted u-shaped channel of a lid.

In the preferred form hereinafter described in detail, the container is formed with an undercut to receive the locking feature of the snap-ring and, spaced below the undercut, another load transfer shoulder upon which the lower edge of the outer wall of the snap-ring rests when the snap-ring is fully applied to the container sidewall.

Also in the preferred form, the snap-ring comprises downwardly and inwardly projection portions which, when the snap-ring is fully applied to the container, rests against the inside surface of the container sidewall to act as a back support for the snap-on feature.

Other applications of the present invention will become apparent to those skilled in the art when the following description of the best mode contemplated for practicing the invention is read in conjunction with the accompanying drawings.

BRIEF DESCRIPTION OF THE DRAWINGS

The aforementioned features of the invention and the preferred embodiment thereof will become clear upon reference of the appended drawings of which.

DETAILED DESCRIPTION

Figure 1:
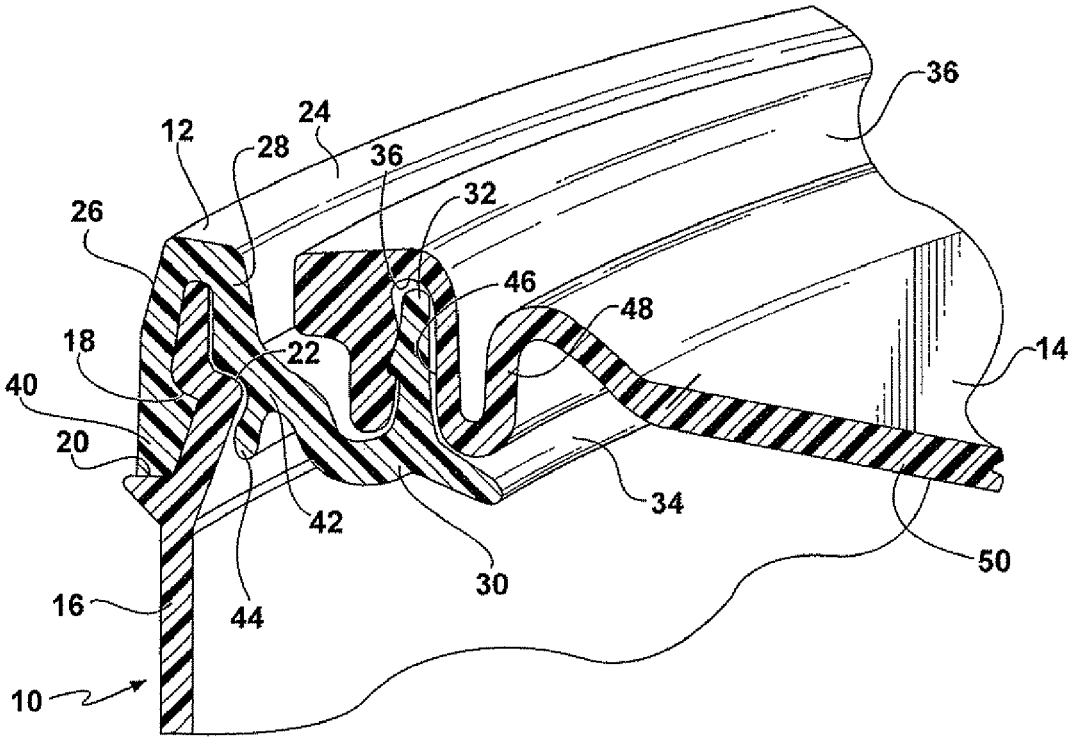
FIG. 1 is a perspective view, in section, of a container assembly embodying the invention.
Figure 2:
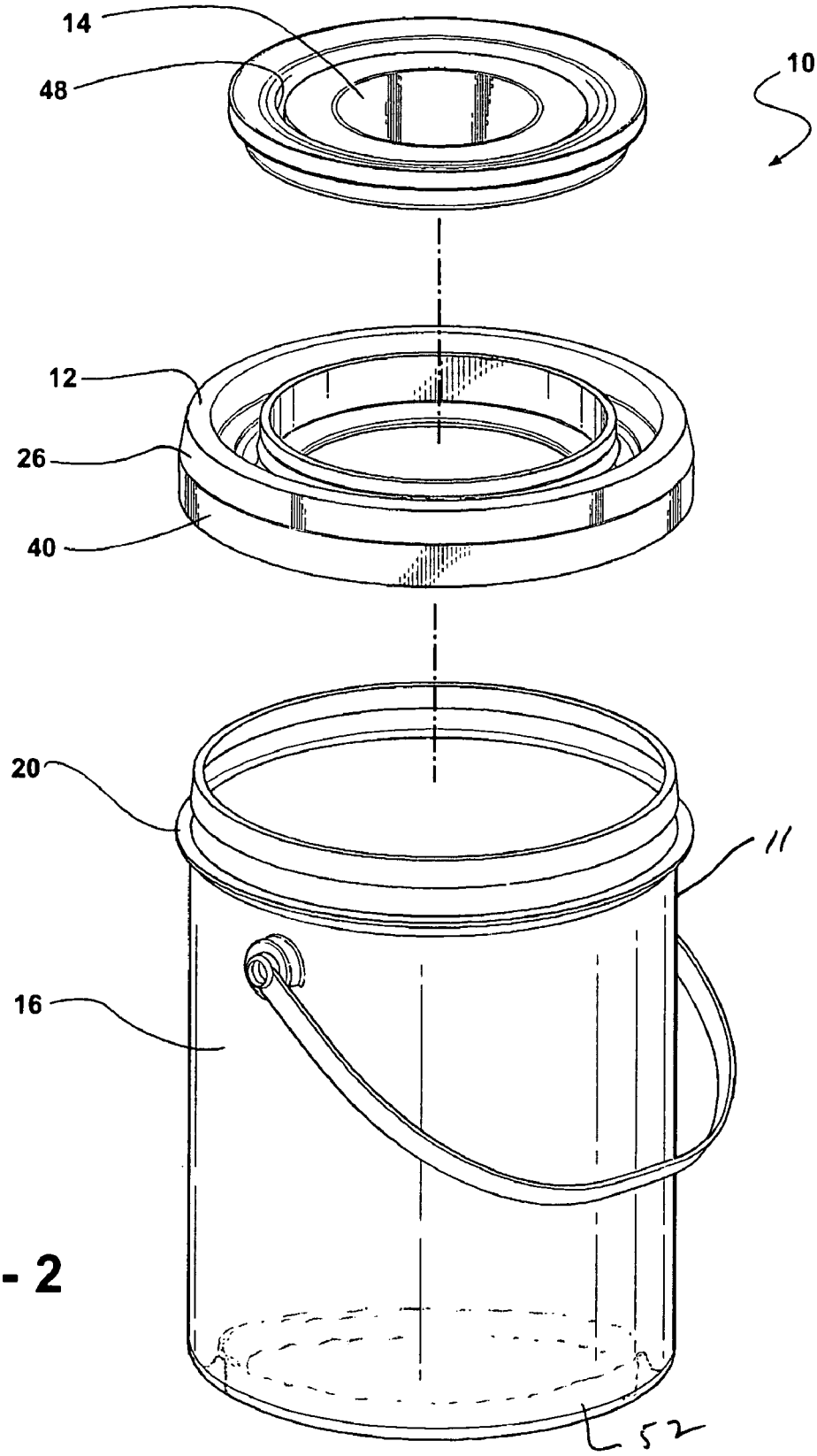
FIG. 2 is an exploded perspective view of the container, snap-ring and closure of FIG. 1.

Referring to the drawings, the illustrative embodiment of the invention is shown to comprise the molded plastic container assembly 10 including a container 11 of generally cylindrical shape, a molded plastic snap-on snap-ring 12 of generally annular shape and a molded plastic lid or closure 14 of generally disk-like shape. In general, the snap-ring 12 serves as a transition structure between the container sidewall 16 and the lid 14 so as to permit the lid to be attached to and removed from the container 11 to access the contents of the container.

A suitable material for use in constructing all of the container 11, snap-ring 12 and lid 14, is high density polyethelene (HDPE). However, other plastic materials may also be used to provide structural components of the proper strength, stiffness and durability.

Containers with snap-rings and closures of the type generally described herein are advantageously used to package paint and other liquid materials for retail sale. However, the present invention may be utilized to advantage in the packaging, shipping and sales of many different products.

Describing the combination in detail, the container 11 comprises a generally cylindrical sidewall 16 which defines a lipless top edge. An undercut 18 is formed below the top edge of container 11 and, approximately ¼" below the undercut 18, a load transfer stacking shoulder 20 is formed for purposes to be described. Opposite the undercut 18 is an interior load transfer stacking surface 22 also for purposes to be described.

The snap-ring 12 comprises an annular outer portion 24 and an integral annular inner portion 30. The terms "inner" and "outer" are used here to refer to relative radial portions. The outer portion 24 comprises an outer wall 26 and, integral therewith, an inner wall 28 which together define an inverted u-shaped channel which receives the top portion of the container sidewall 16 shown. The lower skirt portion of the outer wall 26 is formed with a thickened annular inwardly projecting portion 40 which cooperates with the undercut 18 to snap lock the snap-ring 12 to the container sidewall 16. The dimensions of the outer wall 26 of the snap-ring are such that when the snap-ring 12 is in place on the container sidewall 16, the bottom edge of the outer wall 26 rests on the shoulder 20. This permits vertical loads caused by stacking multiple containers on top of one another to be transferred from the snap-rings 12 to the container sidewall 16.

The inner wall 28 of the snap-ring 12 is formed with an inwardly directed jog 42 thereby defining an inward flange portion which rests on the shoulder 22 to further provide a stacking load transfer function. An annular downwardly and inwardly projecting lip 44 acts as a back support for the snap-on function.

The inner portion 30 of the snap-ring 12 is provided with an upstanding annular projection 32 having an undercut 46 which cooperates with an inverted u-shaped channel portion 36 of the lid 14 in the fashion more fully described in the aforementioned '618 patent. Therefore the disclosure of the '618 patent, although not repeated in full herein, is incorporated by reference into this disclosure and is to be considered a part thereof to the extent pertinent. An inwardly projecting annular flange 34 on the snap-ring cooperates with the serpentine portion 48 of the lid structure to provide additional vertical load support. The lid further comprises a relatively flat interior deck portion 50.

The bottom 52 of the container is preferably configured to permit stacking of the containers one on top of the other.

OPERATION

In operation, the snap-ring 12 is oriented over the container 11 with the inverted u-shaped channel of the snap-ring 12 poised to receive the upper edge of the container sidewall 16. Either manually or through the use of appropriate automation machinery, the snap-ring is forced down onto the top edge of the container sidewall 16 until the projection 40 flexes outwardly and snaps into the space provided by the undercut 18. At this time, the snap-ring projection 40 also rests on the stacking shoulder 20 and the interior shoulder of the inner wall 28 of the snap-ring presses on the shoulder 22 to further provide a vertical load transfer function.

In the typical operation, the container with the snap-ring in place is now filled, although the filling procedure may also be carried out before the snap-ring is applied. Although adhesive bonding may be used as a supplemental securement feature, it is generally unnecessary to weld or otherwise adhesively bond the snap-ring 12 to the container 10.

Thereafter, the lid 14 is applied by forcing the inverted u-shaped channel portion 36 over the upstanding annular projection 32 until the lid mates with the undercut 46 on the outside surface of the projection 32. The container and contents are now ready for shipment. The lid 14 may be removed with a suitable tool such as a pry bar or screwdriver by the end user or by an intermediate merchant if it is necessary to open the container to add a coloring ingredient.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. The combination of a molded plastic container and a snap-on, snap ring attached to said container comprising:

a molded plastic container having a continuous side wall defining an open top having an upper peripheral edge, said sidewall having an undercut formed on the outer surface thereof, an outwardly projecting upwardly facing substantially flat shoulder below the undercut, and an upwardly facing annular shoulder formed on the inner surface thereof opposite the undercut;

a molded plastic snap-on, snap-ring attached to the peripheral edge for use in securing a lid to said container;

said snap-ring comprising an annular plastic structure having an outer portion including an inverted u-shaped channel having an outer wall and an inner wall, which walls are spaced apart to receive the peripheral edge of said container fully there between;

said outer wall having an annular inwardly extending projection on the lower edge thereof to cooperate with and fit into said container undercut; said outer wall defining below the projection an annular end surface which rests on said upwardly facing substantially flat shoulder when said snap-ring is in place on said container; and said inner wall having an annular stacking surface which rests on said upwardly facing annular shoulder when said ring is snapped onto said peripheral edge.

2. The combination as defined in claim 1 further comprising a lid having a peripheral inverted U-shaped channel thereon and wherein:

said annular plastic structure further comprises an inner portion including an upstanding annular projection spaced inwardly from said inner wall to lockingly receive the inverted U-shaped channel of the lid.

3. The combination of a molded plastic container and a snap-on, snap ring attached to said container comprising:

a molded plastic container having a continuous side wall defining an open top having an upper peripheral edge, said sidewall having an undercut formed on the outer surface thereof, an outwardly projecting upwardly facing shoulder below the undercut, and an upwardly facing annular shoulder formed on the inner surface thereof opposite the undercut;

a molded plastic snap-on, snap-ring attached to the peripheral edge for use in securing a lid to said container;

said snap-ring comprising an annular plastic structure having an outer portion including an inverted u-shaped channel having an outer wall and an inner wall, which walls are spaced apart to receive the peripheral edge of said container fully there between;

said outer wall having an annular inwardly extending projection on the lower edge thereof to cooperate with and fit into said container undercut; said outer wall defining below the projection an annular end surface which rests on said upwardly facing shoulder when said snap-ring is in place on said container; and said inner wall having an annular stacking surface which rests on said upwardly facing annular shoulder when said ring is snapped onto said peripheral edge, wherein the molded plastic snap-on snap-ring further comprises an annular and flexible, downwardly extending back support formed integrally with said inner wall and which lies against the inside surface of the container side wall when the snap-on snap ring is attached to said container.

* * * * *